US006979758B2

(12) United States Patent
Eidelman et al.

(10) Patent No.: US 6,979,758 B2
(45) Date of Patent: Dec. 27, 2005

(54) METHOD AND APPARATUS FOR MINE AND UNEXPLODED ORDNANCE NEUTRALIZATION

(75) Inventors: Shmuel Eidelman, Rockville, MD (US); Samuel Goroshin, New York, NY (US)

(73) Assignee: Science Applications International Corporation, San Diego, CA (US)

( * ) Notice: Subject to any disclaimer, the term of this patent is extended or adjusted under 35 U.S.C. 154(b) by 108 days.

(21) Appl. No.: 10/428,632

(22) Filed: May 5, 2003

(65) Prior Publication Data

US 2004/0059176 A1 Mar. 25, 2004

Related U.S. Application Data

(63) Continuation of application No. 09/828,907, filed on Apr. 10, 2001, now Pat. No. 6,765,121, which is a continuation of application No. 09/270,829, filed on Mar. 18, 1999, now Pat. No. 6,232,519, which is a continuation of application No. 08/976,493, filed on Nov. 24, 1997, now abandoned.

(51) Int. Cl.[7] ..... A62D 3/00
(52) U.S. Cl. ..... 588/403; 86/50; 89/1.13; 102/402; 102/424
(58) Field of Search ..... 588/102, 103, 588/403; 89/1.13; 86/50; 102/402, 424

(56) References Cited

U.S. PATENT DOCUMENTS

| | | | | |
|---|---|---|---|---|
| 3,109,369 | A * | 11/1963 | Plumley | 102/1 |
| 3,771,413 | A | 11/1973 | Sieg et al. | |
| 3,800,715 | A | 4/1974 | Boller | |
| 3,916,805 | A | 11/1975 | Kalfadelis et al. | |
| 4,046,055 | A | 9/1977 | McDanolds et al. | |
| 4,493,239 | A | 1/1985 | Pedersen | |
| 5,035,756 | A | 7/1991 | Covino | |
| 5,140,891 | A | 8/1992 | Husseiny et al. | |
| 5,198,188 | A | 3/1993 | Holt et al. | |
| 5,212,343 | A | 5/1993 | Brupbacher et al. | |
| 5,223,661 | A | 6/1993 | Sabri | |
| 5,347,930 | A | 9/1994 | Baronquel et al. | |
| 5,434,335 | A | 7/1995 | Brummond et al. | |
| 5,434,336 | A | 7/1995 | Adams et al. | |
| 5,445,690 | A | 8/1995 | Wulfman | |
| 5,463,169 | A | 10/1995 | Hebisch et al. | |
| 5,516,971 | A | 5/1996 | Hurley | |
| 5,523,517 | A | 6/1996 | Cannizzo et al. | |
| 5,582,119 | A | 12/1996 | Barkdoll | |
| 5,668,342 | A | 9/1997 | Discher | |
| 5,790,963 | A * | 8/1998 | Welham | 588/202 |
| 5,936,184 | A * | 8/1999 | Majerus et al. | 89/1.13 |
| 6,232,519 | B1 | 5/2001 | Eidelman et al. | |

FOREIGN PATENT DOCUMENTS

| | | |
|---|---|---|
| EP | 525808 | 2/1993 |

* cited by examiner

*Primary Examiner*—Stanley S. Silverman
*Assistant Examiner*—Peter J Lish
(74) *Attorney, Agent, or Firm*—Banner & Witcoff, Ltd.

(57) ABSTRACT

A method for neutralization of the explosive content of mines and UXO by essentially completely consuming the explosive by combustion or decomposition before any explosion occurs. A charge of a compound that reacts with an extremely high heat-release rate is ignited on or near the casing of the device to be neutralized. The intense exothermic reaction generates high temperature combustion products that will disrupt the casing, thus leading to combustion or decomposition of the explosive. The holes melted in the mine casing enable ignition of a large area of the explosive charge and provide easy access for atmospheric air to support active burnout of the explosive.

The apparatus comprises the compound that reacts with a high heat release rate, an ignition source, and a container for the assembly.

26 Claims, 1 Drawing Sheet

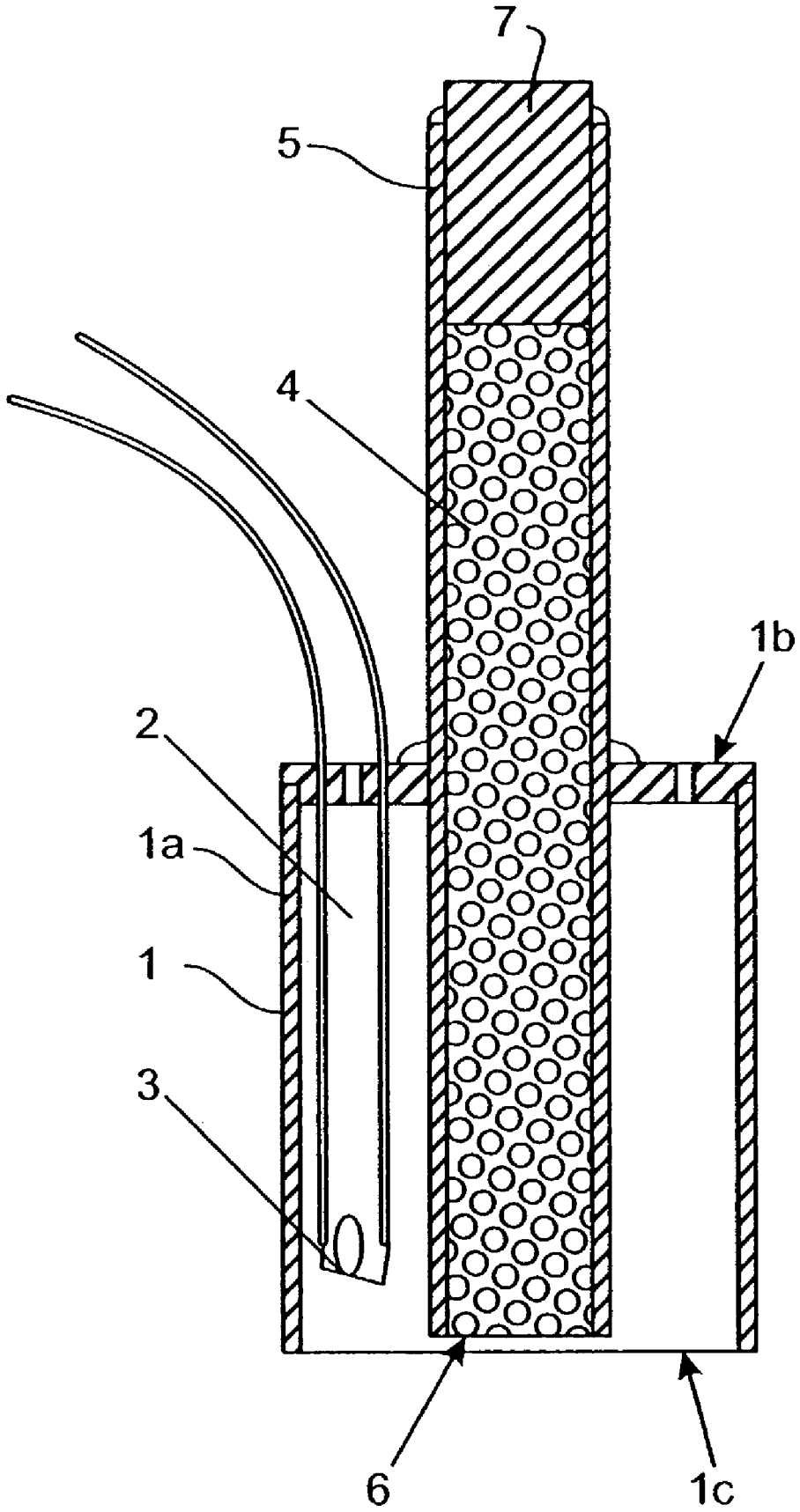
7
5
4
1b
2
1a
1
3
6
1c

METHOD AND APPARATUS FOR MINE AND UNEXPLODED ORDNANCE NEUTRALIZATION

CROSS REFERENCE TO RELATED APPLICATIONS

This application is a continuation of application Ser. No. 09/828,907, filed Apr. 10, 2001 now U.S. Pat. No. 6,765,121, which is a continuation of application Ser. No. 09/270,829, filed Mar. 18, 1999, now U.S. Pat. No. 6,232,519, which in turn is a continuation of application Ser. No. 08/976,493 filed Nov. 24, 1997, now abandoned.

BACKGROUND OF THE INVENTION

1. Field of the Invention

This invention is related to a method for neutralization of the explosive content of mines and unexploded ordnance ("UXO"). The invention also is related to apparatus used to practice the method.

2. Description of Related Art

Explosive-filled ordnance of divers type often must be destroyed or otherwise neutralized. Such ordnance includes not only unexploded shells, rockets, and fuses, but also ordnance that is designed to explode on contact or is triggered to explode by another activation mechanism, such as a detonator, such as a land, underwater, or shallow water mine. There exist many sources of UXO which must be destroyed. Ordnance that did not operate properly, that no longer is suitable for use, or that is surplus, are some examples of UXO that often must be destroyed or otherwise neutralized. A 'land mine,' i.e., a mine placed on the surface, partially covered, or completely covered by ground and designed to explode upon contact or otherwise, is another example of a type of device that requires neutralization.

Neutralization can be required for various reasons. Unexploded shells, rockets, and fuses may be the result of ordnance that did not operate properly, for example, in a war zone or in a practice range. Surplus ordnance often is destroyed to avoid stockpiling unneeded quantities of ordnance, or as part of an arms reduction agreement. Mines often need to be neutralized to make a mined area safe for entry.

Known methods and apparatus for neutralizing UXO are not completely satisfactory.

One class of methods requires that the ordnance be taken to a central location for processing. For example, U.S. Pat. No. 5,434,335 discloses destruction of explosives and other 'energetic' materials by feeding a stream of the material with diluent into a high temperature bath of molten alkali metal or alkaline earth metal salt. Organic material is destroyed, and inorganic material is separately recovered from the salt. Other destruction methods are known for particular types of material. For example, U.S. Pat. Nos. 3,916,805 and 5,516,971 are directed to destruction of nitrogenous explosives, the former by controlled oxidation and the latter by digestion in aqueous caustic solution. U.S. Pat. No. 5,523,517 is directed to destruction of nitramine explosive by heating a mixture of such explosive with an aqueous dispersion of powdered metal that does not react with water. Examples of suitable metals include aluminum, zinc, manganese, and magnesium. Controlled combustion of selected combinations of materials is disclosed in U.S. Pat. No. 5,463,169. Treatment of explosive waste is carried out in a bed of granular material, such as sand. The 'energetic' material is ignited in the bed, and the granular material absorbs the force of any explosion, dampens the destructive power of propelled debris, and conveniently collects the unexploded debris.

As disclosed in U.S. Pat. No. 5,035,756, devices containing thermite (or Thermit®) mixtures (aluminum and $Fe_3O_4$ powders) have been used to burn vent holes into the propellant/motor portion of ordnance carried on, e.g., aircraft for the purpose of venting the propellant during a fire. Thus venting the propellant is meant to preclude excessive pressure and explosion of the propellant during such a fire. This patent is directed to a thermite composition comprising particular components intended to yield selected density, tensile strength, and elasticity characteristics.

Another class comprises methods that can be applied to either material in ordnance or only to the explosive material removed from the ordnance. One such method is disclosed in U.S. Pat. No. 5,434,336. Sulfur and the explosive material are heated in an oxygen-free atmosphere to a temperature above 110° C. for a time sufficient to degrade the material to non-explosive reaction products. When liquid sulfur is used and introduced to the reactor in a stream of solvent, particularly carbon disulfide ($CS_2$), the UXO need not be dismantled before treatment. Use of a liquid sulfur stream is preferred with waxy or cast explosives, as the warm sulfur will soften the explosive and improve mixture thereof with the sulfur. However, in accordance with this method, an oxygen-free atmosphere must be maintained during the initial step. Then, thus-decomposed material is subjected to high temperature sulfur vapor to complete the destructive reaction.

Another class of methods is directed to reformulation of the 'energetic' material. For example, U.S. Pat. No. 5,445,690 discloses a method for reformulating polymer and wax-bound explosives to improve, inter alia, brisance. Added materials can include oxidizer, plasticizer, and stabilizer.

None of the above-described methods is suitable for destruction or neutralization of UXO and mines in situ. Known methods of in situ destruction are unsatisfactory.

In one class of such methods, mines and UXO's are destroyed after detection by detonating a small explosive charge placed in or projected to the vicinity of the object to be destroyed. Detonation of this small charge causes a sympathetic detonation of the object and thus neutralizes the mine or UXO. Alternatively, a plurality of objects to be destroyed are removed from the site and relocated into one area, then detonated. This method requires use of an explosive charge and personnel skilled in the use of explosives. It also causes as much, if not more, property damage than the mine itself.

Another class of methods of neutralizing UXO's and mines include use of plows, rollers, or flails attached to an armored vehicle. For example, U.S. Pat. No. 3,771,413 discloses use of wheels mounted on a vehicle, such as a tank, to detonate pressure-activated land mines buried in the ground in the path of the wheels. This method is slow, as the area to be cleared typically must be traversed a plurality of times, typically with the top layer of ground scraped away (itself a costly and dangerous undertaking) between traverses; cumbersome, as the necessary equipment must be sturdy, yet transportable from site to site; expensive, as it requires equipment and trained personnel; tedious, as a grid or other manner of ensuring thorough coverage must be established and adhered to assiduously; and dangerous, as the object is to cause the mines and UXO's to detonate.

A class of methods is directed to temporarily disabling mines and UXO's, typically by cooling them to a temperature at which it becomes inoperative. In U.S. Pat. No. 4,046,055, the case of the mine or UXO is penetrated so that liquid nitrogen can be injected therein. This method is unsatisfactory, as merely piercing the outside of the device may cause it to detonate. U.S. Pat. No. 3,800,715 discloses drawing a mine or UXO into a tubular shell, closing the ends, and introducing liquid nitrogen into the interior. This method is less than satisfactory because it requires that the explosive device be moved before it is made less dangerous. Whereas each of these methods requires that each object be treated individually, U.S. Pat. No. 5,140,891 discloses a method and apparatus for neutralizing mines and UXO's by spraying cryogenic material over the area to be cleared to render the materials at least temporarily inoperable. Ordnance removed by this method should be placed in liquid nitrogen as quickly as possible.

Another area-wide treatment is disclosed in U.S. Pat. No. 4,493,239. The area to be treated is infused with an electrolyte and subjected to a direct current voltage to enhance natural corrosion. The temperature of the area also may be increased, for example, by covering the area with black material, such as a plastic sheet, to further accelerate corrosion. This method is unsatisfactory because it takes on the order of five to ten years and requires continuing attention.

Thus, there exists a need for an easy, safe, and quick method for neutralizing mines and UXO's.

SUMMARY OF THE INVENTION

The invention is directed to a method for neutralization of the explosive content of mines and UXO. The invention also is related to apparatus used to practice the method. In accordance with the method, the explosive charge will be essentially completely consumed by combustion or decomposition before any explosion occurs.

The method comprises reacting, on or near the surface of the mine or UXO, a charge of a compound that reacts with an extremely high heat-release rate. The intense exothermic reaction generates high temperature combustion products that will melt, burn, or otherwise disrupt, a metal, plastic, composite, or wooden casing, thus leading to combustion or decomposition of the explosive. In an alternative embodiment, the high temperature in the casing decomposes the content thereof, causing the pressure in the casing to rise, fracturing the casing before the explosive detonates. In either case, the disrupted casing enables ignition of a large area of the explosive charge and provides easy access for atmospheric air to support active burnout of the explosive.

The apparatus comprises the compound that reacts with a high heat release rate, an ignition source, and a container for the assembly.

BRIEF DESCRIPTION OF THE DRAWINGS

FIG. 1 illustrates a typical apparatus of the invention.

DETAILED DESCRIPTION OF THE INVENTION

The invention is directed to a method for neutralization of mines and UXO. The method of the invention causes combustion and essentially complete burnout of an explosive charge in the mine or UXO before the detonator causes any small remaining quantity of the explosive charge to explode. The method comprises reacting, on or near the surface of the mine or UXO, a charge of a compound comprising components that react with each other exothermically, releasing a large amount of heat at a high rate. The intense exothermic reaction generates high temperature combustion products that metal, plastic, composite, and wooden mine casing, thus leading to combustion or decomposition of the explosive. The disrupted casing enables ignition of a large area of the explosive charge and provides easy access for atmospheric air to support active burnout of the explosive.

Delivery of oxygen to the burning explosive can be enhanced by including an oxidizer in association with the heat-releasing compound. The oxidizer is a compound that releases oxygen-rich gas when heated, thus further enhancing disruption of the casing and combustion or decomposition of the explosive charge.

The apparatus comprises the compound comprising components that release a large amount of heat at a high rate when they react with each other, an ignition source associated with the compound, and a container for the assembly.

For convenience, the method of the invention will be described as it applies generally to ordnance, and particularly to land mines. However, it should be understood that the invention applies to all forms of UXO's and mines, including but not limited to unexploded shells, rockets, and fuses. Mines of all sorts, including both land mines and water-borne mines, can be neutralized in accordance with the method of the invention. The UXO or mine may, but need not, have a detonator.

Any type of explosive can be neutralized in accordance with the method of the invention. Polymeric explosives; nitrogenous explosives, including nitramine explosives; explosives that yield acidic reaction products; and explosives that yield basic reaction products are exemplary of kinds of explosives that can be neutralized in accordance with the method of the invention. Binary explosives, TNT-based aluminized explosives, and plastic-bonded explosives also are neutralized in accordance with the method of the invention. These listed types of explosives are merely exemplary; any type of explosive can be neutralized in accordance with the method of the invention.

The method of the invention can be used to neutralize ordnance having a casing which melts or burns at a temperature below the reaction temperature of the compound used to in accordance with the method of the invention, or which fractures before the explosive detonates. Thus, ordnance having a metal, plastic, composite, or wood casing, or a combination thereof, is neutralized in accordance with the method of the invention. Aluminum, brass, and steel have been successfully melted or burned through in accordance with the method of the invention, as have plastics and wood. Typically, wood burns under conditions of the method of the invention.

In accordance with the method of the invention, a charge of a compound that reacts exothermically to release a large amount of heat at a high rate to form high temperature combustion products is placed on or near the ordnance to be destroyed or neutralized. Upon ignition, the compound reacts, generating a large amount of heat at a high rate to form high temperature combustion products. These combustion products disrupt the casing, thus enabling oxygen to reach the explosive material so that it is burned rather than detonated. Thus, the explosive is oxidized or decomposed under controlled conditions and subsequently essentially completely consumed in the degraded casing. If the mine or ordnance is fused, a small quantity of uncombusted explosive material may detonate before the burning thereof is complete as a result of a heat-triggered detonation. However, the force of any such explosive detonation is minor compared with the full design force of the entire mine.

One such compound suitably used in the method of the invention is ordnance propellant that burns at a temperature sufficiently high and evolves heat at a rate sufficient to neutralize ordnance. The reaction products typically are gaseous, and can disrupt casing of ordnance. Skilled practitioners recognize that the reaction products of such propellants often are oxygen enriched, and typically are gaseous. Thus, propellant delivers to the site additional oxygen, thus serving, in part, as an oxidizer, as set forth below. With the guidance provided herein, a skilled practitioner can select an appropriate propellant for neutralization of many mines and ordnance.

In accordance with a preferred embodiment of the invention, the compound is a compound that can undergo a self propagating high temperature synthesis ("SHS compound"). Such SHS compounds form liquid and solid combustion products, or a combination thereof, which disrupts the casing and neutralizes the ordnance. For convenience, the invention will be described in detail with regard to SHS compounds.

The SHS compounds used in the practice of the invention typically are compositions comprising combinations of components that can react with each other via a gasless reaction process. As used herein, a gasless reaction process is one which produces less than about 5 wt percent gas products. A summary of typical compositions and characteristics of SHS compounds, and the reaction products thereof, is set forth in Table 1 below. Each of these SHS compounds can be used in the method of the invention. Further, there may exist now or in the future additional suitable compounds which undergo an SHS reaction of which the inventors are not aware. Such compounds would suitably be used in the method of the invention.

TABLE 1

| Reactants | T, K | Resultant Product |
|---|---|---|
| Carbides | | |
| Hf + C | 3900 | HfC - solid |
| Zr + C | 3778 | ZrC - solid |
| Ti + C | 3289 | TiC - 17.3% liquid, 82.7% solid |
| Si + C | 1874 | SiC - solid |
| Borides | | |
| Ti + B | 3349 | TiB - solid |
| Zr + 2B | 3332 | $ZrB_2$ - 78.2% liquid, 21.8% solid |
| Ta + 2B | 2728 | $TaB_2$ - solid |
| Mo + B | 2309 | MoB - solid |
| Silicides | | |
| 2Si + 3Zr | 2443 | 92% $Si_3Zr_5$ - solid; 4.8% Zr - liquid; 3.2% S - liquid |
| 3Si + 5Ti | 2402 | $Si_3Ti_5$ - 84.8% solid, 15.2% liquid |
| 2Si + Mo | 1926 | $MoSi_2$ - solid |
| Intermetallics | | |
| Al + Co | 1918 | AlCo - 70% solid, 30% liquid |
| Al + Ni | 1912 | AlNi - 41.8% solid, 58.2% liquid |
| Ti + 3Ni | 1469 | $Ni_3Ti$ - solid |
| Chalcogenides | | |
| Cr + S | 2168 | CrS - liquid |
| In + S | 1980 | InS - liquid |
| Mn + S | 3352 | MnS - liquid |
| Ti + S | 4001 | TiS - 99.5% liquid, 0.5% gas |
| x Cr + y Mn + z Ti + (x + y + z) S | | |

TABLE 1-continued

| Reactants | T, K | Resultant Product |
|---|---|---|
| Thermite Reaction | | |
| $3Fe_3O_4$ + 8Al | 3284 | 44.8% $Al_2O_3$ - liquid; 55.2% Fe - liquid |

SHS compounds used in the method of the invention are manufactured in various ways, depending upon the components thereof. The following methods are exemplary. Various methods of manufacture of the SHS compounds, and the characteristics of the elemental components thereof, are known to skilled practitioners. In particular, skilled practitioners recognize that the particle size of the components typically affects the reaction rate of the resulting SHS compound.

Although the inventors do not wish to be bound by theory, it is believed that compounds comprising relatively large particles react more slowly than compounds comprising relatively small particles because the larger particles have less surface area for reaction per unit mass. Particles larger than about 100 microns may react too slowly to be effective in neutralizing all types of mines and other UXO's. Therefore, the particle size of the elemental components of the SHS compounds suitable for use in accordance with the method of the invention preferably is less than about 100 microns, more preferably less than about 50 microns, and most preferably less than about 25 microns. An especially preferred particle size is less than about 1 micron.

The carbide-producing compounds, such as Ti+C, can be manufactured by mixing titanium powder with carbon powder to obtain a homogeneous mixture. A ball mill or similar apparatus is suitable for this purpose. The homogeneous powder then is formed into a charge of desired conformation, i.e., size and shape, by compaction.

The chalcogenide-producing compounds, i.e., the metal-sulfur compounds, can be prepared by forming an intimate mixture of metal powder and sulfur powder. The mixture then is melted, with agitation as required to maintain homogeneity. The molten compound then is poured into a form or other mold, in which it allowed to solidify to form a monolithic solid. Chalcogenide-producing compounds also can be manufactured by infusing, covering, or otherwise coating or infiltrating carbide pellets with the elemental components. Thus-loaded carbide pellets then are formed into the desired shape. The chalcogenide-producing SHS compounds can be made of any combination of metals and sulfur that supports SHS.

Preferably, the SHS compounds comprise essentially pure reactants in essentially stoichiometric proportion. Using stoichiometric proportions of pure reactants helps ensure efficient neutralization by maximizing heat delivery. Impurities typically lower the reaction temperature and interfere with generation of high temperature reaction products, both directly (e.g., by reacting with reactants that otherwise would undergo an SHS reaction or with oxygen) and indirectly (e.g., by reacting with other components at lower temperature). Further, non-stoichiometric proportion typically wastes reactant. Skilled practitioners recognize that it may be preferable to have a small stoichiometric excess of a reactant, particularly a less-expensive reactant, to ensure complete reaction.

Each SHS compound has measurable or quantifiable characteristics and properties, including reaction temperature, thermal conductivity, thermal capacity, reaction rate, ignition temperature, and the like. A selected value of a characteristic can be obtained by combining SHS compounds in appropriate proportion. The chalcogenide combinations described above illustrate this point; the combination and proportion of metals can be selected to yield a SHS compound having desired characteristics and properties.

SHS compounds also can be combined to yield a product having characteristics and properties superior to those obtained by single SHS compounds alone. For example, appropriate combinations of SHS compounds yield improved storage life, provide desired performance at minimum cost, simplify the manufacturing method, facilitate formation of diverse configurations, focus thermal energy, and achieve other technical or commercial goals. With the guidance provided herein, skilled practitioners recognize how to prepare such combinations of compounds.

SHS compounds used in the practice of the method of the invention are not explosive. Indeed, they are essentially inert under typical handling and manufacture conditions. Therefore, they are safely handled, transported, and stored in large quantities at temperatures between about −30° C. and 60° C. Because they are not explosive, personnel using the material need not be specially trained in the handling of explosives and detonators.

Some SHS compounds (chalcogenide-producing compounds, for example) are monolithic, non-porous, and insensitive to moisture, and so do not require particularized handling to avoid degradation by water. Further, the resistance to water contributes to a long storage life.

The chalcogenide-producing compounds also are easily configured to form the charge best suited to the ordnance to be neutralized. As used herein, 'configuration' means more than mere physical shape. Rather, configuration criteria include mass and physical conformation. Typically, the melting temperature of the metal-sulfur material is about 110–120° C. Therefore, the metal-sulfur compound can easily be melted and formed into a charge of a desired shape and size. Indeed, once formed into a desired shape, the metal-sulfur compound is a monolithic structure which does not require a container to retain its shape at ambient conditions.

The difference between the ignition temperature of a SHS compound (e.g., typically between about 350–400° C. for a chalcogenide-producing compound) and the highest temperature at which it is handled (typically between about 150–200° C.) provides a wide range of temperature in which the compounds can safely be handled, including manufacture of a desired conformation substantially without risk of ignition.

This ability to easily form a charge in a desired conformation, i.e., in a desired mass and shape, provides flexibility in application of the method of the invention to mines and UXO. This flexibility affords the opportunity to accommodate different conditions under which the method of the invention is practiced. For example, the method of the invention can be applied under a wide range of conditions, such as differing terrain and weather (including temperature, humidity, windiness, and precipitation). The method of the invention also can be applied to divers types of mines and UXO having different kinds and quantities of explosive materials and different materials of construction, including in particular, of casing shapes and materials.

The shape and quantity of SHS compound used in accordance with the method of the invention is selected to ensure essentially complete combustion of the explosive to be neutralized without deleterious explosion. The composition, thickness, and shape of the casing containing the explosive to be neutralized; the composition, quantity, and shape of that explosive; and the ambient conditions in which the neutralization is to be carried out, are significant determinants of the quantity and shape of the SHS compound. Thus, a greater quantity of SHS compound will be necessary to perforate a metal casing than a plastic one, or for a casing that is thicker than a thinner casing made from the same composition. Similarly, an explosive charge that is deeply buried will require a larger quantity of SHS compound than a similar charge on the surface of the ground.

One of the performance requirements for neutralization of mines by one embodiment of the invention is rapid melting of the mine casing and initiation of the combustion or decomposition of the explosive. Thus, the SHS compound used to neutralize a mine preferably releases heat in the direction of the mine. To achieve better heat exchange between the SHS reaction products and the casing of the mine or UXO being neutralized, use of an SHS compound that reacts to form a liquid product is preferred.

In accordance with another embodiment of the invention, the high temperature reaction product does not perforate, burn, or melt the casing. Rather, the explosive and other material in the casing decomposes in the heat imparted by the reaction product. The rate of pressure increase is sufficient to yield a pressure at which the casing fractures before the explosive detonates. Any remaining explosive thus burns or decomposes, and the device is effectively neutralized. The fracturing of the casing also may cause the remaining explosive to be scattered, thus neutralizing the mine.

The method of the invention can be used to neutralize ordnance with or without modifying the casing. The integrity of the casing can be compromised before the method of the invention is utilized. Such compromise can be purposeful. For example, the casing may have been drilled, bored, pierced, weakened as by scoring, or otherwise traversed or compromised in accordance with another neutralization method. The casing also may be compromised before application of the method of the invention so that the high temperature reaction products of the method of the invention can more easily reach the explosive. Also, the casing may have been cracked or punctured, or otherwise compromised when the ordnance remained unexploded after delivery.

Preferably, the charge used is larger than the minimum charge calculated or believed to be sufficient, because a partially-neutralized mine is less stable than, and therefore more dangerous than, an untouched mine. For example, chalcogenide-producing compound in a 100 g mass is sufficient to neutralize an M-19 plastic mine with about 10 kg of TNT explosive. Skilled practitioners recognize these and other relationships, and can, with the guidance provided herein, prepare appropriate SHS compound charges for neutralization of mines and UXO.

In accordance with the method of the invention, the SHS compound charge is ignited in any manner which suitably and reliably will ignite the charge. Typically, ignition is effected remotely, but the charge can be ignited directly. However, the latter technique is more dangerous, and preferably is avoided.

The SHS compound charge is ignited by a safety fuse, an electric match, an ignition wire embedded therein or placed thereon, or any other suitable material which will ensure that the SHS compound ignites and then maintains the heat-releasing reaction for a period sufficient to ensure propagation of a reaction front in the SHS charge that causes essentially complete reaction of the compound in the charge. A plurality of such ignition sources can be used. Such plural sources often are distributed throughout the charge to ensure evenness of ignition. Skilled practitioners recognize that such plural ignition sites also can be arranged to ignite the SHS compound in a manner that caused a reaction front to develop in the compound. In particular, the reaction front is formed to converge upon the casing. In this way, heat is focused on the casing. Each of these ignition apparatus, and their manner of operation, are known to skilled practitioners, who can select a suitable apparatus for use.

Ignition by wire embedded in the charge is preferred. This method of ignition is easily done remotely, thus keeping safe the person effecting the neutralization; it is highly reliable; and it is simple and easily carried out under extreme or difficult conditions. The wire is simply energized, or caused to 'glow,' by any suitable power source sufficient to provide a temperature that is sufficiently high to ignite the SHS compound utilized for a period sufficient to ignite the compound charge. For example, a temperature of between about 300 and 450° C. is sufficient to ignite a chalcogenide charge. Typically, a generator or, more typically, a battery, is used to energize the wire. Such a device can be operated from a remote location or by timer or similar delay mechanism. Skilled practitioners recognize that the ignition temperature will depend upon the temperature and the chemical and physical composition of the charge.

As the SHS compound charge reacts, reaction products are formed at high temperature. These high temperature reaction products flow (if liquid) or are deposited onto (if a solid) the casing, thereby melting, burning, or otherwise perforating the casing. The thus-flowing or -deposited high temperature reaction products form holes in the casing. A number of relatively small holes, or a lesser number of relatively large holes, are formed by the high temperature reaction products. Preferably, a lesser number of relatively large holes form in the casing. Whereas any hole in the casing provides the possibility for oxygen to be present at the site at which the explosive is to burn, larger holes are preferred to smaller holes. Larger holes facilitate access of oxygen to the sites at which the explosive burns. If the quantity of oxygen available is insufficient to support combustion of the explosive, the explosive is more likely to detonate, rather than burn or otherwise decompose under controlled conditions.

If possible, it is preferred to ensure that high temperature reaction products are prevented from spreading over a relatively large area of the casing. Rather, limiting the high temperature reaction products to a relatively smaller area increases the efficiency of the neutralization process. Whereas solid reaction products typically will be deposited onto an area of the casing without spreading, liquid products (from the SHS reaction) tend to spread. Preventing molten SHS reaction products from spreading, or flowing, over a larger area of the casing, or, indeed, from flowing off the casing, concentrates the heat from the reaction products in a relatively small area and reduces heat loss. This pooling of liquid high temperature reaction products tends to increase the likelihood of forming relatively few large holes in the casing.

Delivery of oxygen to the burning explosive in accordance with the method of the invention can be enhanced by including an oxidizer together with or in association with the SHS compound. The presence of an oxidizer, i.e., a compound that decomposes to yield an oxygen-rich gas, helps ensure that a minimum quantity of oxygen is delivered to the burning explosive at a preselected time. Such supplemental oxygen may aid the fire to burn hotter, more reliably, or for a longer time. Release of the oxygen in the direction towards the casing of the mine or UXO will also facilitate rapid burning, and therefore perforation, of the casing.

A suitable oxidizer releases oxygen in response to a characteristic or property of the SHS compound. Preferably, oxidizer used herein causes oxygen to be released by decomposition of the oxidizer in the heat of the combustion. Suitable oxidizers include ammonium nitrate, potassium nitrate, sodium chlorate, barium nitrate, and sodium nitrate ($NaNO_3$). Skilled practitioners recognize that select propellants generate oxygen-rich gaseous combustion products, and so can be used as an oxidizer.

Release of oxygen from any oxidizer used can be controlled, inter alia, by selection and location of the oxidizer in relation to the reacting charge, or to the phenomenon that causes the oxygen to be liberated. Thus, oxygen can be released early or late in the SHS compound charge reaction cycle, or even thereafter. In particular, release of oxygen after the SHS compound charge has completely burned provides a supply of oxygen to the mass of explosive to increase the burn time of the explosive mass and minimize the likelihood of a detonation.

The characteristics of the oxidizer can affect when oxygen is released. For example, an oxidizer that releases oxygen at high temperature will release oxygen later in the burn cycle than an oxidizer that releases oxygen at a lower temperature. The introduction of oxygen from an oxidizer that releases oxygen only at higher temperature delays introduction of oxygen.

The apparatus of the invention also can be designed to accelerate or to retard oxygen liberation from the oxidizer. For example, to retard introduction of oxygen, the oxidizer could be well-insulated from the heat of reaction or of the flame. Skilled practitioners recognize other ways of obtaining these results. Thus, with the guidance herein, a skilled practitioner will be able to control the delivery of the supplemental oxygen, if any is used.

If desired, it is possible to remove at least part of any debris or overburden on the casing. Removal of overburden increases the efficiency of the method of the invention by increasing the amount of high temperature reaction products that contact the casing and the amount of oxygen that reaches the burning materials. Any convenient way of removing such overburden is suitable, subject, of course, to the requirement that the removal does not detonate the explosive. In particular, a release of gas to blow the overburden off the casing is preferred. The gas can be obtained from a cylinder of compressed or liquefied gas, or from a composition which releases gas (whether by reaction or decomposition), or any other suitable source.

In accordance with the method of the invention, a SHS compound charge is placed on or near a mine to be neutralized. The SHS compound charge preferably is ignited and allowed to react. The reaction of the SHS compound charge forms hot composition(s) that disrupt the casing and ignite the explosive charge.

The SHS compound charge, together with oxidizer, if any, is delivered to contact, or to rest in the vicinity of, the mine to be neutralized. Overburden and debris may be at least partially removed by gas released before or during the reaction of the SHS compound. Such removal affords easier access to the casing for the high temperature reaction products and of oxygen to the casing and explosive. Apparatus by which the SHS compound charge and the optional oxidizer are delivered comprises a container for the SHS compound, an ignition source, and, optionally, a container for the oxidizer.

FIG. 1 illustrates apparatus of the invention. As can be seen therein, container 1 containing SHS compound 2, in which is placed ignition wire 3. Container 1 can be of any material, but must enable high temperature liquid combustion products to be released essentially as they are formed onto the mine to be neutralized. This container can be made from materials having low thermal conductivity to reduce the heat lost to the surroundings during and after the SHS reaction. Suitable materials of construction for this container include clay ceramics, refractory ceramics, porous refractory materials, and other heat-insulating materials that resist the high reaction temperatures.

A second, inner sleeve 1*a* in the form of a cylinder, without top or bottom, can be used to further reduce heat loss and thus increase the temperature of the SHS reaction products. This sleeve can be a separate liner, or can be formed integrally with or coated on another material. The bottom 1*c* of container 1 typically is open toward the mine or UXO. A relatively flimsy end cap (not shown) can be used to protect the apparatus and its contents intact.

In accordance with an embodiment of the invention, bottom 1*c* may have a circumferential member (not shown) of material suitable to restrain high temperature liquid reaction products from spreading. This circumferential member also may be attached directly to the casing, with the apparatus then attached thereto. The circumferential member acts as a dam to the liquid flow and tends to restrain the liquid from flowing over a relatively larger area of the casing. Skilled practitioners will, with the guidance provided herein, be able to select suitable materials from which such a dam can be formed. Typically, clays, elastomeric materials resistant to the temperatures expected to be encountered (i.e., the temperature of the liquid product), and other materials, such as ceramics, can be used.

Container 1 carries therein SHS compound charge 2. The quantity of SHS compound charge 2 is pre-selected to be sufficient to perforate and ignite the target mine or UXO. Ignition wire 3 is embedded in metal-sulfur compound charge 2. Ignition wire 3 is connected to a power source (not shown) to provide electricity to heat the wire to a temperature sufficient to ignite the SHS compound.

The apparatus of the invention may comprise container 5 containing oxidizer 4. As illustrated in FIG. 1, oxidizer container 5 has an end 6 embedded in SHS compound charge 2. The opposite end of container 5 contains plug 7, which can be made from any convenient material. Plug 7 may be made from durable materials, so as to be resistant to the ravages of the fire, or may be easily compromised, so as to be easily destroyed and provide early release of oxidizing materials, or the oxygen released thereby.

The apparatus of the invention also may have cover 1*b*, which may, but need not, accommodate oxidizer container 5. Such an accommodation is illustrated in FIG. 1. Cover 1*b*, if present, typically is relatively sturdy, and serves to aid in the direction of heat and high temperature reaction products toward the casing.

Apparatus of the invention also can comprise other features. For example, the apparatus of the invention also can have a container for gas or a gas-generating composition for the purpose of removing at least a part of any overburden. Compressed gas or a gas-releasing composition is suitable.

Apparatus of the invention can be associated with the casing when the mine or ordnance is first manufactured. In this way, the entity that placed mines in an area can neutralize its own mines after they are no longer needed. Skilled practitioners recognize that suitable apparatus of the invention can be formed integrally or in close association with (i.e., attached to) the casing to be destroyed. In this way, it is not necessary to identify and separately place neutralizing apparatus on each device to be neutralized. For this embodiment of the invention, means for remotely initiating the ignition of the SHS is preferred.

The method of the invention has a number of advantages compared to known methods of mine and UXO neutralization. Neutralization in accordance with the method of the invention does not lead to sympathetic detonation of other mines in the vicinity, such as in an area in which mines having pressure-sensitive triggers. Any detonation of a mine during or after practice of the method of the invention typically has a low pressure rise, as the casing holes will have afforded the opportunity to combust the explosive material. Minor explosions may occur, typically at the end of the burn, but typically they do no damage to other property.

Skilled practitioners recognize that some UXO and mines comprise propellant. Such propellant also may be neutralized during practice of the method of the invention to neutralize explosive.

The controllable nature of mine neutralization in accordance with the method of the invention greatly reduces the likelihood that a person will be injured by an explosion before or during the method of the invention. Mines can be neutralized in situ, and therefore need not be removed (itself a dangerous task) for neutralization.

The resultant solid product of the method of the invention is an environmentally unobjectionable monolithic, solid, and non-magnetic reaction product.

The disclosure set forth herein describes the invention with particularity with regard to land mines. As set forth above, it should be understood that the method also applies to essentially all forms of mines and UXO. A more complete understanding can be obtained by reference to the following specific examples which are provided herein for purposes of illustration only, and are not intended to limit the scope of the invention.

EXAMPLES

Examples 1–5

Table 2 below summarizes five examples of the method of the invention. Each example is directed to neutralization of a different type of mine with an SHS compound. Both fused and unfused mines were neutralized.

| Example | 1 | 2 | 3 | 4 | 5 |
|---|---|---|---|---|---|
| Mine Type | M-15 | M-19 | TS-50 | OZM-72 | PMD-6 |
| Mine Purpose | Anti-tank | Anti-tank | Antipersonnel | Antipersonnel | Antipersonnel |
| Casing | Steel | Plastic | Plastic | Steel | Wood |
| Neutralizing Charge | | | | | |
| SHS Compound | Chalcogenide Compound Containing 20 mole % Cr, 30 mole % Mn, and 50 mole % S. | | | | |
| Quantity, grams | 100–150 | 100–150 | 200–250 | 100–150 | 100–150 |
| Oxidizer | | | | | |
| Compound | Sodium Nitrate | Sodium Nitrate | None | Sodium Nitrate | Sodium Nitrate |
| Quantity, grams | 30–50 | 30–50 | | 30–50 | 30–50 |
| SHS Container | Steel | Steel | Ceramic | Steel | Steel |
| Result[1] 1 | UC, UC, FCE | UC, UC, FCE | UC, UC, UC | FCEP | UC |

[1]'UC' means Unfused Mine Neutralized by Combustion; 'FCE' means Fused Mine Neutralized by Combustion and Subsequent Minor Explosion; 'FCEP' means Fused Mine Neutralized by Combustion and Subsequent Minor Explosion, with Propellant Neutralized.

We claim:

1. A method for neutralizing a mine or unexploded ordnance comprising explosive in a casing, said method comprising the steps of (a) reacting a compound that undergoes a self propagating high temperature synthesis (SHS) reaction to form high temperature reaction products in quantity and at a rate sufficient to disrupt the casing; wherein the reactive compound is selected from the group consisting of (i) a combination of carbon and a metal that undergoes an SHS reaction with carbon to form a carbide, (ii) a combination of boron and a metal that undergoes an SHS reaction with boron to form a boride, (iii) a combination of silicon and a metal that undergoes an SHS reaction with silicon to form a silicide, (iv) a combination of at least two metals selected from the group consisting of aluminum, nickel, and titanium that in combination undergo an SHS reaction to form an intermetallic alloy; and (v) a combination of sulfur and a metal that undergoes an SHS reaction with sulfur to form a chalcogenide;

(b) causing the high temperature reaction products to disrupt the casing and ignite the explosive; and (c) burning or decomposing the explosive for a time sufficient to destroy the explosive.

2. The method of claim 1 wherein the mine or unexploded ordnance is at least partially immersed in water.

3. The method of claim 1 wherein the reactive compound is an essentially stoichiometric combination of carbon and a metal selected from the group consisting of hafnium, zirconium, titanium, silicon, and blends thereof.

4. The method of claim 1 wherein the reactive compound is an essentially stoichiometric combination of boron and a metal selected from the group consisting of titanium, zirconium, tantalum, molybdenum, and blends thereof.

5. The method of claim 1 wherein the reactive compound is an essentially stoichiometric combination of silicon and a metal selected from the group consisting of titanium, zirconium, molybdenum, and blends thereof.

6. The method of claim 1 wherein the reactive compound is an essentially stoichiometric combination of sulfur and a metal selected from the group consisting of chromium, indium, titanium, manganese, iron, and blends thereof.

7. The method of claim 1, further comprising supplying an oxygen-rich gas stream to the casing or explosive to enhance disruption of the casing or burning or decomposition of the explosive.

8. The method of claim 1, wherein the reaction products are mostly liquid.

9. The method of claim 8, further comprising limiting the spread of any liquid high temperature reaction products.

10. The method of claim 1, further comprising initiating the reaction of the SHS compound in step (a) at a plurality of locations sufficient to create a reaction front that converges on the casing.

11. The method of claim 1, wherein the reactive compound comprises particles having particle size less than about 100 microns.

12. The method of claim 11, wherein the reactive compound comprises particles having particle size less than about 50 microns.

13. The method of claim 12, wherein the reactive compound comprises particles having particle size less than about 25 microns.

14. The method of claim 13, wherein the reactive compound comprises particles having particle size less than about 1 micron.

15. The method of claim 1, wherein the casing has been perforated before the SHS compound is reacted.

16. The method of claim 1, wherein the mine or unexploded ordnance further comprises propellant, and the propellant also is burned or decomposed.

17. A method for neutralizing a mine or unexploded ordnance comprising explosive in a casing, said method comprising the steps of:

(a) reacting a compound that reacts to form high temperature reaction products in quantity and at a rate sufficient to disrupt the casing;

(b) causing the high temperature reaction products to disrupt the casing and ignite the explosive; and (c) burning or decomposing the explosive for a time sufficient to destroy the explosive, wherein the mine or unexploded ordnance is at least partially overburdened by ground or debris, and further comprising removing at least part of the overburden therefrom by a release of gas.

18. A method for neutralizing a mine or unexploded ordnance having a casing comprising explosive material, said method comprising the steps of (a) reacting a compound which undergoes a self propagating high temperature synthesis (SHS) reaction to form high temperature reaction products in quantity and at a rate sufficient to decompose the content of the casing; wherein the reactive compound is selected from the group consisting of (i) a combination of carbon and a metal that undergoes an SHS reaction with carbon to form a carbide, (ii) a combination of boron and a metal that undergoes an SHS reaction with boron to form a boride, (iii) a combination of silicon and a metal that undergoes an SHS reaction with silicon to form a silicide, (iv) a combination of at least two metals selected from the group consisting of aluminum, nickel, and titanium that in combination undergo an SHS reaction to form an intermetallic alloy; and (v) a combination of sulfur and a metal that undergoes an SHS reaction with sulfur to form a chalcogenide;

(b) decomposing the content of the casing by heating the casing with the high temperature reaction products for a time and at a rate sufficient to increase the pressure in the casing to cause the casing to fracture and, before the explosive detonates, (i) scatter the explosive or (ii) burn or decompose the explosive for a time sufficient to destroy the explosive.

19. The method of claim 18, further comprising limiting the spread of any liquid high temperature reaction products.

20. A method for neutralizing a mine or unexploded ordnance having a casing comprising explosive material, said method comprising the steps of:

(a) reacting a reactive compound that undergoes a self propagating high temperature synthesis (SHS) reaction to form high temperature reaction products in quantity and at a rate sufficient to decompose the content of the casing, wherein the reaction products are mostly liquid;

(b) limiting the spread of the liquid high temperature reaction products;

(c) supplying an oxygen-rich gas stream to the casing or explosive to enhance decomposition of the casing or burning or decomposition of the explosive; and (d) decomposing the content of the casing by heating the casing with the high temperature reaction products for a time and at a rate sufficient to increase the pressure in the casing to cause the casing to fracture and, before the explosive detonates, (i) scatter the explosive or (ii) burn or decompose the explosive for a time sufficient to destroy the explosive;

wherein the reactive compound is an essentially stoichiometric combination of sulfur and a metal selected from the group consisting of chromium, indium, titanium, manganese, iron, and blends thereof; and wherein the reactive compound consists essentially of particles having particle size less than about 100 microns.

21. The method of claim 20 wherein the reactive compound consists essentially of particles having particle size less than about 1 micron.

22. A method for neutralizing a mine or unexploded ordnance comprising explosive in a casing, said method comprising the steps of:

(a) reacting a reactive compound that undergoes a self propagating high temperature synthesis (SHS) reaction to form high temperature reaction products in quantity and at a rate sufficient to disrupt and perforate the casing, wherein the reaction products are mostly liquid;

(b) causing the high temperature reaction products to disrupt and perforate the casing at a plurality of locations sufficient to create a reaction front that converges on the casing and thereafter ignites the explosive;

(c) limiting the spread of the liquid high temperature reaction products;

(d) supplying an oxygen-rich gas stream to the casing or explosive to enhance disruption of the casing or burning or decomposition of the explosive; and (e) burning or decomposing the explosive for a time sufficient to destroy the explosive;

wherein the reactive compound is an essentially stoichiometric combination of sulfur and a metal selected from the group consisting of chromium, indium, titanium, manganese, iron, and blends thereof, and wherein the reactive compound consists essentially of particles having particle size less than about 100 microns.

23. The method of claim 22 wherein the mine or unexploded ordnance is at least partially immersed in water.

24. The method of claim 22 wherein the mine or unexploded ordnance is at least partially overburdened by ground or debris, and further comprising removing at least part of the overburden therefrom by a release of gas.

25. The method of claim 22 wherein the reactive compound consists essentially of particles having particle size less than about 1 micron.

26. The method of claim 22 wherein the mine or unexploded ordnance further comprises propellant, and the propellant also is burned or decomposed.

* * * * *